US006929457B2

(12) United States Patent
Matsuura et al.

(10) Patent No.: US 6,929,457 B2
(45) Date of Patent: Aug. 16, 2005

(54) GAS COMPRESSOR

(75) Inventors: Toshinari Matsuura, Chiba (JP); Okikazu Kuwahara, Chiba (JP); Tetsuya Toyokata, Chiba (JP)

(73) Assignee: Calsonic Compressors Manufacturing Inc., Narashino (JP)

( * ) Notice: Subject to any disclaimer, the term of this patent is extended or adjusted under 35 U.S.C. 154(b) by 0 days.

(21) Appl. No.: 10/616,383

(22) Filed: Jul. 9, 2003

(65) Prior Publication Data

US 2004/0126262 A1 Jul. 1, 2004

(30) Foreign Application Priority Data

Aug. 30, 2002 (JP) ..... 2002-255330

(51) Int. Cl.[7] ..... F03C 2/00; F04C 2/00

(52) U.S. Cl. ..... 418/93; 418/76; 418/82; 418/268

(58) Field of Search ..... 418/93, 256, 268, 418/76, 82, 84

(56) References Cited

U.S. PATENT DOCUMENTS 4,636,153 A * 1/1987 Ishizuka et al. ..... 418/268
4,711,620 A * 12/1987 Takahashi et al. ..... 418/268
4,867,658 A 9/1989 Sugita et al.
4,936,761 A 6/1990 Hasegaki et al.

FOREIGN PATENT DOCUMENTS

JP 61116087 A * 6/1986 ..... F04C/18/344
JP 2002227784 A * 8/2002 ..... F04C/18/344

OTHER PUBLICATIONS

Patent Abstracts of Japan vol. 006, No. 249 (M–177), Dec. 8, 1982 JP 57 146092 A (Matsushita Denki Sangyo KK), Sep. 9, 1982.
Patent Abstracts of Japan vol. 008, No. 043 (M–279), Feb. 24, 1984 JP 58 197491 A (Toyoda J1D0 Shokki Seisakusho KK), Nov. 17, 1983.
Patent Abstracts of Japan vol. 013, No. 418 (M–871), Sep. 18, 1989 JP 01 155095 A (Suzuki Motor Co Ltd), Jun. 16, 1989.
Patent Abstracts of Japan vol. 009, No. 311 (M–436), Dec. 7, 1985 JP 60 145476 A (Matsushita Denki Sangyo KK), Jul. 31, 1985.

* cited by examiner

*Primary Examiner*—Theresa Trieu
(74) *Attorney, Agent, or Firm*—Adams & Wilks

(57) ABSTRACT

A rotary vane gas compressor has a cylinder, a rotor in the cylinder, and vanes slidably disposed in radial vane grooves in the rotor to define compression chambers for intaking, compressing and discharging compressed gas during rotation of the rotor. A flat groove communicates with bottom portions of the vane grooves during intaking and compression of the gas in the compression chambers, and a high pressure supplying hole communicates with the bottom portions of the vane grooves during end stage compression of the gas at times when the bottom portions of the vane grooves are not in communication with the flat groove. A communication passage establishes communication between the flat groove and the high pressure supplying hole at the start of operation of the gas compressor to supply high pressure gas to the vane groove bottom portions during start-up to quickly urge the vanes into contact with the cylinder.

20 Claims, 8 Drawing Sheets

DIFFERENCE BETWEEN PRIOR ART AND INVENTION OF THIS EMBODIMENT IN TERMS OF STARTING PERFORMANCE OF GAS COMPRESSOR (AVERAGE VALUES WHEN n = 10)

STARTING CONDITIONS Nc=800rpm Pd=0.392MPaG . Ps=0.420MPaG

GAS COMPRESSOR

BACKGROUND OF THE INVENTION

1. Field of the Invention

The present invention relates to a vane rotary type gas compressor for use in an automotive air conditioning system or the like and, in particular, to a vane rotary type gas compressor improved in terms of vane projectability at the start up of operation of the compressor.

The present invention relates to a vane rotary type gas compressor for use in an automotive air conditioning system or the like and, in particular, to a vane rotary type gas compressor improved in terms of vane projectability at the start up of operation of the compressor.

2. Description of the Related Art

FIGS. 6 through 8 show a conventional vane rotary type gas compressor.

As shown in FIGS. 6 through 8, in this kind of vane rotary type gas compressor, refrigerant gas is introduced into a suction chamber 2 from the piping of an air conditioning system (not shown) through a suction port 2*a*. The refrigerant gas introduced into the suction chamber 2 is sucked into a cylinder chamber 5 in a cylinder 3 by the torque of a rotor 4 in the cylinder 3 and is compressed therein. The compressed refrigerant gas is discharged into an exhaust chamber 6, stored temporarily therein, and returned to the piping of the system from a discharge port 6*a*.

As the structure of a compressor main body 1 will be described specifically. The cylinder 3 with an elliptical inner peripheral surface is equipped with the rotor 4. A plurality of slit-like vane grooves 16 are radially formed in the outer peripheral surface of the rotor 4, and vanes 17 are fitted in the vane grooves 16 so as to be capable of radially projecting and retracting from and into the rotor 4. These vanes 17 are capable of moving toward and away from the inner peripheral surface of the cylinder 3 by the centrifugal force due to the rotation of the rotor 4 and back pressure of vane groove bottom portions 16*a*, and divide the cylinder chamber 5 defined by the inner peripheral surface of the cylinder 3 and the outer peripheral surface of the rotor 4 into a plurality of compression chambers 5*a*.

Further, in the outer periphery of the cylinder 3, there are provided discharge chambers 19 and discharge valves in each discharge chambers. Formed in the inner peripheral surface of the cylinder 3 are cylinder discharge holes 18 establishing communication between the discharge chambers 19 and the cylinder chamber 5. Further, arranged in the front side of the cylinder chamber 5 are suction passages 2*b* establishing communication between the suction chamber 2 and the cylinder chamber 5. Formed in the cylinder 3 are cylinder suction passages 3*a* establishing communication between the suction passages 2*b* and the rear side of the cylinder chamber 5.

The compressor main body 1 is constructed as described above, and the compression chambers 5*a* defined by the vanes 17 repeatedly undergo changes in volume by rotation of the rotor 4. The refrigerant gas in the suction chamber 2 is sucked into the compression chambers 5*a* through the suction passages 2*b* and the cylinder suction passages 3*a* by the compression chambers 5*a*, which repeatedly undergo changes in volume. The sucked refrigerant gas is compressed by the compression chambers 5*a*. After the compression, the refrigerant gas is discharged into the discharge chambers 19 through the cylinder discharge holes 18.

As described above, the gas compressor sucks in and compresses refrigerant gas, so that it necessary to effect lubrication and sealing on plain bearings and other sliding portions, etc. in the compressor main body 1 and on the sliding portions such as the rotor 4 and the vanes 17 and the compression chambers 5*a* in the cylinder 3, and lubricant is used for that purpose.

Thus, in the compressor main body 1 and the cylinder 3, there is provided a supplying system for supplying lubricant. The lubricant supplying system in the compressor main body 1 and the cylinder 3 will be described. Lubricant is stored in an oil sump 7 formed in the lower portion of the exhaust chamber 6. The lubricant stored in the oil sump 7 is supplied to the various portions mentioned above. More specifically, lubricant is supplied to a plain bearing 9*a* in the rear side block 9 and a plain bearing 8*a* in the front side block 8. Further, lubricant is supplied to flat, arcuate grooves 11 formed in the rear side block 9 and the front side block 8 so as to be opposed to the rotor 4 and adapted to communicate with one of the plurality of vane grooves 16 when the rotating angle of the rotor 4 is within a fixed angle range. Further, lubricant is supplied to a high pressure supplying hole 10 formed in the rear side block 9 so as to be opposed to the rotor 4 and adapted to communicate with one of the plurality of vane grooves 16 when the rotating angle of the rotor 4 is within a fixed angle range. Further, lubricant is supplied to the compression chambers 5*a* and other sliding portions. At this time, the flat groove 11 and the high pressure supplying hole 10 are spaced apart from each other to a degree such that they do not communicate with each other through the vane grooves 16.

Lubricant is supplied to the plain bearing 9*a* in the rear side block 9 through a first supply passage 12 formed in the rear side block 9 and establishing communication between the oil sump 7 and the plain bearing 9*a*. Lubricant is supplied to the plain bearing 8*a* in the front side block through a third supplying passage 13 formed in the rear side block 9, the cylinder 3, and the front side block 8 and establishing communication between the oil sump 7 and the plain bearing 8*a*. Due to the clearance between the rear side block 9 and the shaft, the lubricant supplied to the plain bearing 9*a* in the rear side block is supplied to the flat groove 11. Lubricant is supplied to the high pressure supplying hole 10 through the first supplying passage 12 formed in the rear side block 9 and establishing communication between the oil sump 7 and the high pressure supplying hole 10. As stated above, the first supplying passage 12 is branched into the plain bearing 9*a* side and the high pressure supplying hole 10 side in the rear side block.

In the above-described lubricant supplying system, during operation of the compressor main body 1, the refrigerant gas compressed through the rotation of the rotor 4 is discharged into the exhaust chamber 6 to increase the pressure inside the exhaust chamber 6, with the result that pressure is applied to the surface of the oil sump 7, whereby lubricant is circulated through the supplying passages to effect lubrication or sealing on the sliding portions. Then, the lubricant is mixed into the refrigerant gas inside the cylinder 3, and discharged into the exhaust chamber 6 to return to the oil sump 7 again, thereby circulating through the compressor main body 1 again. See for example, Japanese Patent Publication Number JP 2002-227784 A.

During the operation of the gas compressor described above, the rotor 4 is rotating at a high speed, and the pressure of the exhaust chamber 6 is higher than that in the suction chamber 2 due to the compressed refrigerant discharged into it, with lubricant in the oil sump 7 circulating through the gas compressor and the flat groove 11 also being filled with lubricant. Thus, in the suction/compression process effected by the rotation of the rotor 4, the vanes 17 are pressed against the inner peripheral surface of the cylinder 3 by the centrifugal force due to the high-speed rotation of the rotor 4 and the vane back pressure due to the supply to the vane groove bottom portions 16*a* of the lubricant in the flat groove 11 communicating with the vane grooves 16. The vanes 17 thus pressed divide the cylinder chamber 5, thereby defining the compression chambers 5*a*.

Here, the suction/compression process refers to the process from starting of an increase in the volume of the compression chambers 5*a* and starting of flowing-in of refrigerant gas into the compression chambers 5*a* to starting of a reduction in the volume of the compression chambers 5*a*, with refrigerant gas not having been discharged from the compression chambers 5*a* yet.

Further, when the refrigerant gas sucking/compressing process has advanced to the stage immediately before discharging refrigerant gas from the compression chambers, the pressure inside the compression chambers 5*a* is increased by the pressure of the compressed refrigerant gas, and this pressure causes the vanes 17 to be pushed back toward the interior of the vane grooves 16 to be nearly separated from the inner peripheral surface of the cylinder 3. However, at the stage immediately before the discharging of refrigerant gas, the high pressure supplying hole 10 is adapted to communicate with the vane grooves 16, and lubricant at a pressure equal to that in the exhaust chamber 6 is supplied from this high pressure supplying hole 10 to the vane groove bottom portions 16*a* to add to the vane back pressure. Due to this vane back pressure, the vanes 17 are prevented from being separated from the inner peripheral surface of the cylinder 3 as a result of being pushed back toward the interior of the vane grooves 16.

However, in the conventional gas compressor described above, it can happen that the rotor 4 rotates at a low speed at the start of the compressor, thus causing a shortage of centrifugal force applied to the vanes 17. When the centrifugal force is insufficient, the projectability of the vanes 17 degenerates, so that the vanes 17 are not pressed against the inner peripheral surface of the cylinder 3, which means there is a fear of the cylinder chamber 5 not allowing division into the compression chambers 5*a*.

Further, at the start of the compressor, there may be a shortage of pressure in the exhaust chamber 6. Further, it can also happen that the temperature condition is rather severe, that the compressor is left unattended for a long period of time, and that the pressures of the suction chamber 2 and of the exhaust chamber 6 are reversed. In such cases, there will be a shortage of lubricant supplied to the flat groove 11 and a shortage of lubricant supplied to the vane grooves 16, resulting in a reduction in the vane back pressure. In such a case also, the projectability of the vanes 17 will deteriorate due to the reduction in the vane back pressure, so that there is a fear of the vanes 17 not being pressed against the inner peripheral surface of the cylinder, making it impossible to divide the cylinder chamber 5 into the compression chambers 5*a*.

When the projectatbility of the vanes 17 thus deteriorates to make it impossible to define the compression chambers 5*a*, the requisite period of time from the start of the compressor to the stage where the suction/compression of refrigerant gas is possible becomes rather long, thereby deteriorating the compression performance at the start of the gas compressor.

SUMMARY OF THE INVENTION

The present invention has been made in view of the above problems. It is an object of the present invention to provide a gas compressor improved in terms of the projectability of the vanes 17 at the start of the compressor and of the compression performance at the start of the compressor.

As stated above, the present invention aims to improve the projectability of the vanes 17 at the start of the compressor. As stated above, in the conventional gas compressor, a deterioration in the projectability of the vanes 17 at the start of the compressor is caused by a shortage of centrifugal force applied to the vanes 17 due to low-speed rotation of the rotor 4, a reduction in the vane back pressure attributable to a shortage of lubricant supplied to the vane grooves 16 due to a shortage of lubricant supplied to the flat groove 11, etc. That is, the deterioration in projectability is caused by deficiency in the force with which the vanes 17 are caused to project into the cylinder chamber 5 to be pressed against the inner peripheral wall of the cylinder 3.

In view of this, in accordance with the present invention, in addition to the vane back pressure due to the lubricant supplied to the vane groove bottom portions 16*a* and the centrifugal force due to the rotation of the rotor 4, there is provided, from some other source, a force for compensating for the deficiency in the force with which the vanes 17 are to be caused to project into the cylinder chamber 5 to be pressed against the inner peripheral wall of the cylinder.

During normal operation of the compressor, the high pressure supplying hole 10 is filled with lubricant supplied from the oil sump 7 through the first supplying passage 12. Thus, as stated above, lubricant at a pressure equivalent to that of the exhaust chamber 6 is supplied to the vane groove bottom portions 16*a* to thereby provide vane back pressure, which prevents the vanes 17 from being pushed back into the vane grooves 16 to be separated from the inner peripheral surface of the cylinder 3. However, for the reasons stated above, at the start of the compressor, there is a shortage of lubricant supplied into the high pressure supplying hole 10. In this state, when the compressor is started, the vanes 17 are caused to protrude to some degree into the cylinder chamber 5, without being pressed against the inner peripheral surface of the cylinder 3. Then, space is formed in each of the vane groove bottom portions 16*a*, so that, due to a suction effect generated between the vanes 17 and the vane grooves 16, the refrigerant gas in the cylinder chamber 5 flows into the vane groove bottom portions 16*a*. Then, when the rotor 4 further rotates, the vanes 17 are inclined to be pushed back into the vane grooves 16 by the inner peripheral surface of the cylinder 3. At this time, the refrigerant gas having flowed into the vane groove bottom portions 16*a* is compressed. When the rotor 4 rotates to attain the stage immediately before discharge, and the vane groove bottom portions 16*a* communicate with the high pressure supplying hole 10, the compressed refrigerant gas is discharged into the high pressure supplying hole 10.

Due to the above-described operation, high pressure refrigerant gas is discharged into the high pressure supplying hole 10 at the start of the compressor to fill the high pressure supplying hole 10 with high pressure refrigerant gas.

In view of this, in accordance with the present invention, in addition to the vane back pressure due to the lubricant in the vane groove bottom portions 16*a* and the centrifugal force due to the rotation of the rotor 4, the high pressure refrigerant gas existing in the high pressure supplying hole 10 is utilized in order to compensate for the deficiency in the force with which the vanes 17 are pressed against the inner peripheral surface of the cylinder 3 at the start of the compressor.

That is, in accordance with the present invention, the high pressure refrigerant gas existing in the high pressure supplying hole 10 is supplied to the vane groove bottom portions 16*a* during the suction/compression process effected by the rotation of the rotor 4, thereby obtaining a third force for causing the vanes 17 to project.

To achieve the above object, in accordance with the present invention, there is provided a gas compressor for sucking in, compressing, and discharging refrigerant gas, characterized by an elliptical cylinder, a rotor rotatably arranged in the cylinder, vane grooves radially formed in the rotor, vanes provided in the vane grooves and capable of projecting and retracting radially with respect to the rotor, a flat groove adapted to communicate with vane groove bottom portions during a refrigerant gas sucking/compressing process, a high pressure supplying hole adapted to communicate with the vane groove bottom portions upon interception of the communication between the vane groove bottom portions and the flat groove in the refrigerant gas compressing process, and a communication passage adapted to establish communication between the flat groove and the high pressure supplying hole at the start of the gas compressor.

According to the present invention, which adopts the above construction, it is possible, at the start of the compressor, to discharge the high pressure refrigerant gas filling the high pressure supplying hole into the flat groove through the communication passage. Thus, it is possible to supply high pressure refrigerant gas to the vane groove bottom portions communicating with the flat groove in the suction/compression process, so that it is possible to compensate for the deficiency of centrifugal force due to low speed rotation of the rotor and the deficiency of lubricant supplied to the flat groove and to enable the vanes to project into the cylinder chamber, thereby improving the vane projectability at the start of the compressor.

Further, in accordance with the present invention, the gas compressor is characterized by a discharge chamber for temporarily storing refrigerant gas discharged from the cylinder, an oil sump formed in a lower portion of the exhaust chamber, a first supplying passage establishing communication between the oil sump and the high pressure supplying hole, and a second supplying passage branching off from the first supplying passage and communicating with the flat groove, the communication passage being formed by the first supplying passage and the second supplying passage.

According to the present invention, which adopts the above construction, it is possible to achieve the object of the present invention solely by additionally providing a conventional gas compressor with the second supplying passage.

Further, in the present invention, it is also possible to adopt a construction in which there is provided in the communication passage a first pressure control valve adapted to be brought into a closed state when the difference between a pressure in the exhaust chamber and a pressure in the flat groove becomes not less than a predetermined value.

Further, in the present invention, it is also possible to adopt a construction in which there is provided in the second supplying passage a first pressure control valve adapted to be brought into a closed state when the difference between a pressure in the exhaust chamber and a pressure in the flat groove becomes not less than a predetermined value.

According to the present invention, which adopts the above construction, it is possible to provide the flat groove with a third force for improving the vane projectability exclusively at the start of the gas compressor, making it possible to cut off any force more than necessary for causing the vanes to project during normal operation of the gas compressor.

Further, according to the present invention, it is also possible to adopt a construction in which there is provided, in the first supplying passage on the downstream side of the oil sump and on the upstream side of a branches off point for the second supplying passage, a second pressure control valve adapted to be brought into the closed state when the difference between the pressure in the exhaust chamber and a pressure at the branches off point for the second supplying passage becomes not more than a predetermined value.

In the present invention, due to the adoption of the above construction, it is possible to efficiently supply the flat groove with the high pressure refrigerant gas supplied from the high pressure supplying hole at the start of the compressor without involving any leakage to the oil sump and the front side plain bearing.

Further, in accordance with the present invention, the gas compressor is characterized by including a third supplying passage situated on the downstream side of the oil sump and branching off from the first supplying passage on the upstream side of the branches off point for the second supplying passage, and a second pressure control valve situated in the first supplying passage and between the branches off point for the second supplying passage and a branches off point for the third supplying passage and adapted to be brought into the closed state when the difference between the pressure in the exhaust chamber and the pressure at the branches off point for the second supplying passage is not more than a predetermined value.

In the present invention, which adopts the above construction, it is possible to efficiently supply the flat groove with the high pressure refrigerant gas supplied from the high pressure supplying hole at the start of the compressor without involving any leakage to the oil sump side and the front-side plain bearing side.

Further, in accordance with the present invention, it is also possible to adopt a construction in which there are provided a third supplying passage further branching off from the above-mentioned branches off point and adapted to supply lubricant to a front portion of the interior of the gas compressor main body, and a third pressure control valve situated at a position in the gas compressor main body in front of the oil sump and inside the third supplying passage behind the branches off point and adapted to be brought into the closed state when the difference between the pressure in the exhaust chamber and a pressure in the third supplying passages is not more than a predetermined value.

In the present invention, due to the adoption of the above construction, it is possible to efficiently supply the flat groove with the high pressure refrigerant gas supplied from the high pressure supplying hole at the start of the compressor without involving any leakage to the oil sump side and the front-side plain bearing side.

BRIEF DESCRIPTION OF THE DRAWINGS

FIG. 2A is a detailed view of a communication passage and a lubricant supplying passage of this embodiment, and FIG. 2B is a detailed view of the communication passage of this embodiment.

FIG. 3A is a detailed view of a communication passage and a lubricant supplying passage of this embodiment, and FIG. 3B is a detailed view of the communication passage of this embodiment.

FIG. 4A is a detailed view of a communication passage and a lubricant supplying passage of this embodiment, and FIG. 4B is a detailed view of the communication passage of this embodiment.

DESCRIPTION OF THE PREFERRED EMBODIMENT

Figure 1:
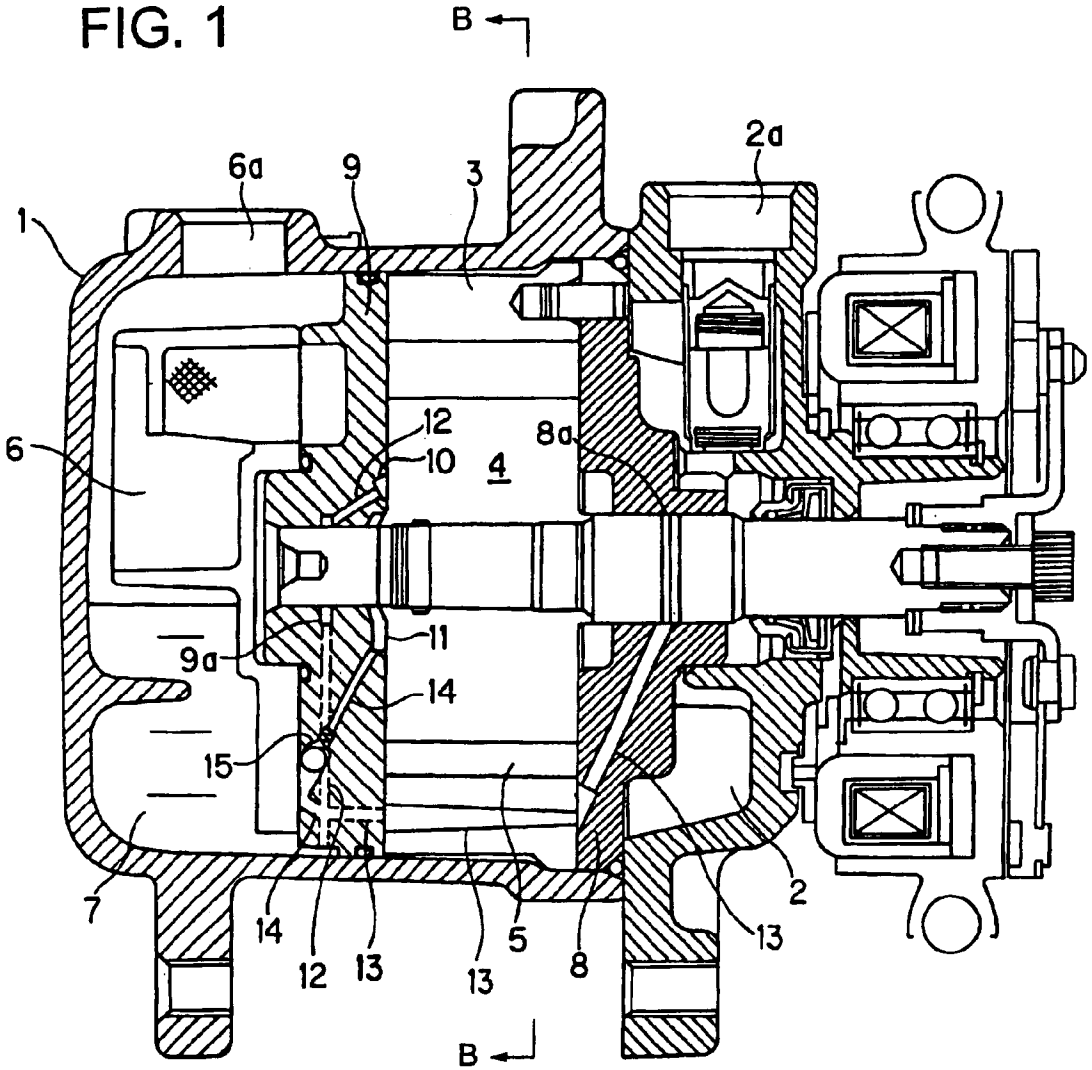
FIG. 1 is a sectional view of a gas compressor according to a first embodiment of the invention.

Embodiments of a gas compressor of the present invention will now be described in detail with reference to FIGS. 1 through 5. In the embodiments, the components which are the same as those in the prior art are indicated by the same reference numerals and symbols, and a detailed description of such components will be omitted. Further, in the present invention, the internal construction of the cylinder 3 is the same as that in the prior art, so that FIG. 8, which is a sectional view of the cylinder 3 of the conventional compressor taken along the line B—B, will be referred to in the following description.

(First Embodiment)

Figure 2B:
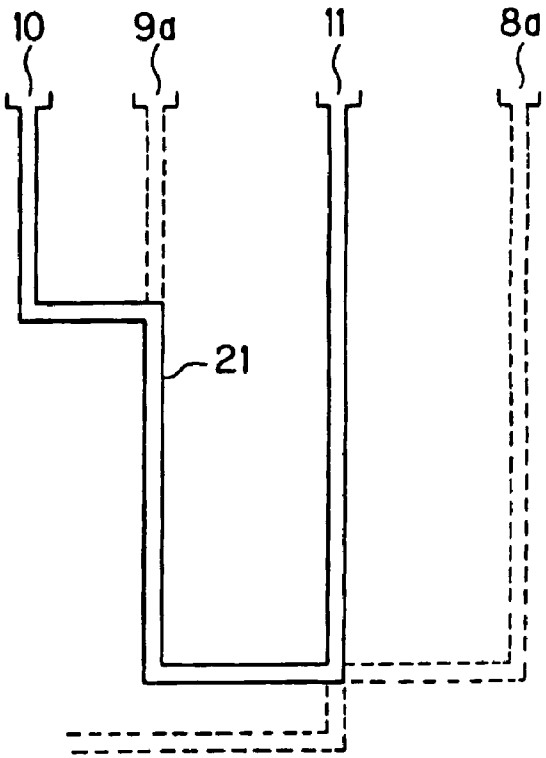
FIGS. 2A and 2B are schematic diagrams schematically showing a main structure portion of the first embodiment.
Figure 2A:
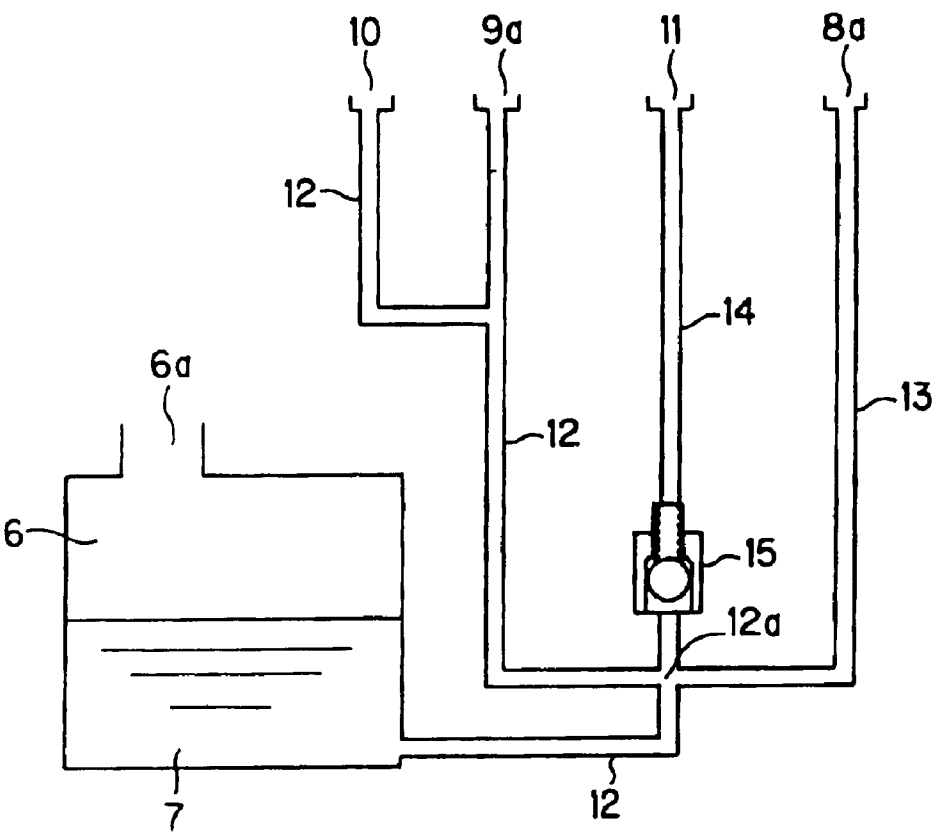

FIG. 1 is a longitudinal sectional view showing a first embodiment of the gas compressor of this invention. FIGS. 2A and 2B are schematic diagrams showing a communication passage and a lubricant supplying passage according to this embodiment.

The gas compressor shown in FIG. 1 is equipped with a first supplying passage 12 which is formed in a rear side block 9 and which serves to communicate an oil sump 7 with a rear side block plain bearing 9*a* and with a high pressure supplying hole 10 through branching. Further, there is provided a third supplying passage 13 branching off from the first supplying passage 12, formed in the rear side block 9, the cylinder 3, and the front side block 8, and establishing communication between the oil sump 7 and a plain bearing 8*a* in the front side block.

Figure 8:
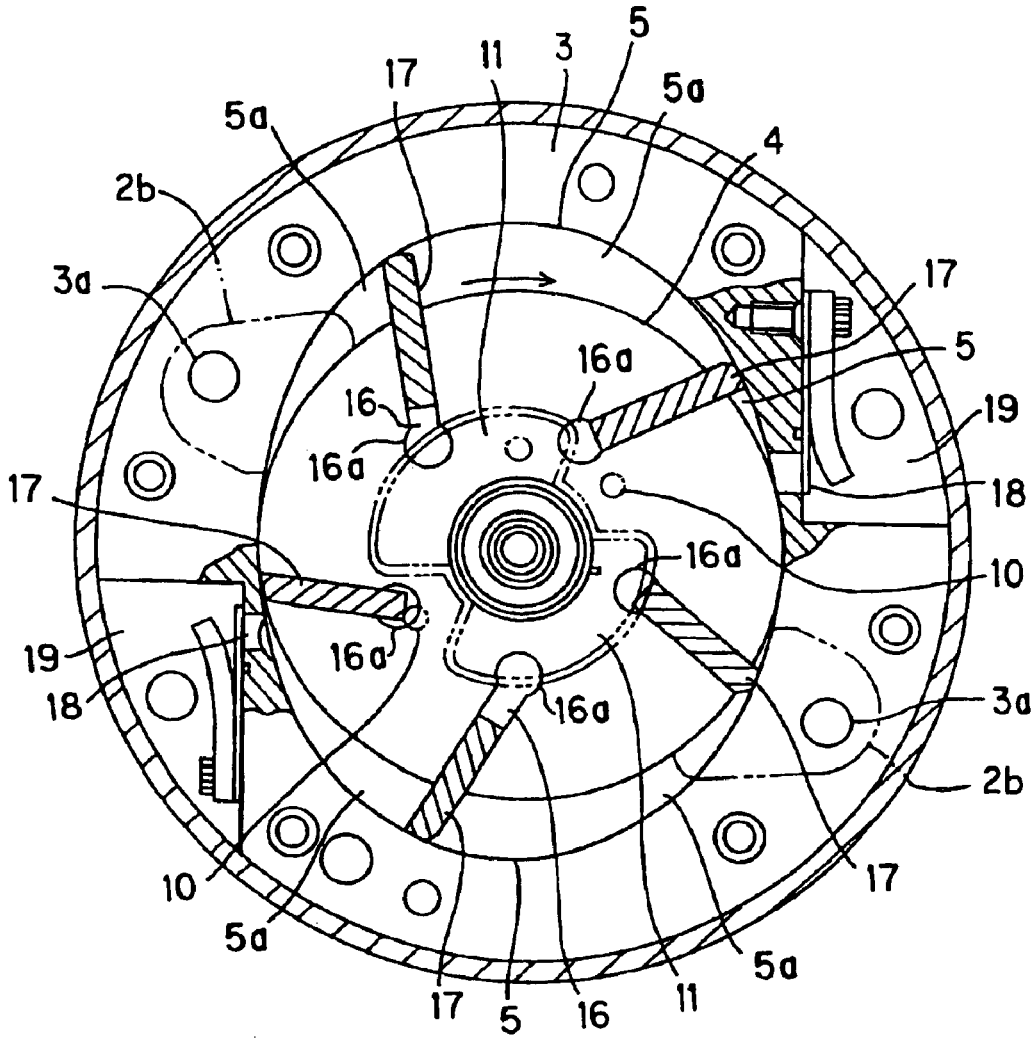
FIG. 8 is a sectional view taken along the line B—B of FIGS. 1 and 6.

Due to the first supplying passage 12 and the third supplying passage 13, lubricant is supplied from the oil sump 7 to the plain bearings and other sliding portions of the gas compressor, to the sliding portions in the cylinder 3 shown in FIG. 8, such as the rotor 4, the flat groove 11, and the vanes 17, and to the compression chambers 5*a* to effect lubrication or sealing thereon.

In this embodiment, there is provided a second supply passage 14 further branching off from the branch-off point 12*a* for the first supplying passage 12 and the third supplying passage 13, formed inside the rear side block 9, and establishing communication between the high pressure supplying hole 10 and the flat groove 11.

Further, a first pressure control valve 15 is provided in the second supplying passage 14.

FIGS. 2A and 2B are schematic diagrams showing a main structure portion of the first embodiment described above. These schematic diagram shows the relationship among the first supplying passage 12, the second supplying passage 14, the third supplying passage 13, the oil sump 7, the high pressure supplying hole 10, the flat groove 11, the plain bearing 8*a* in the front side block, the plain bearing 9*a* in the rear side block, and the first pressure control valve 15.

As shown in FIGS. 2A and 2B, communication is established between the high pressure supplying hole 10 and the flat groove 11 by a communication passage 21 formed by the first supplying passage 12 and the second supplying passage 14.

The operation of this gas compressor, constructed as described above, will be described. At the start of the compressor, when the rotor 4 starts to rotate, the vanes 17, mounted in the vane grooves 16 so as to be radially projectable and retractable, project to a degree that they cannot divide the cylinder chamber 5, by the centrifugal force due to the rotation of the rotor 4 in the suction/compression process.

At this time, space is formed in the vane groove bottom portions 16*a* in an amount corresponding to the projection of the vanes 17, and, due to a sucking effect generated between the vanes 17 and the vane grooves 16 as a result of the sliding of the vanes 17 in the vane grooves 16, the refrigerant gas in the cylinder chamber 5 flows into the vane groove bottom portions 16*a*. In this state, when the rotor 4 further rotates, due to the elliptical configuration of the inner peripheral surface of the cylinder 3, the distance between the inner peripheral surface of the cylinder 3 and the outer peripheral surface of the rotor 4 is reduced as the rotor 4 rotates, so that the forward end portions of the vanes 17 are pressed against the inner peripheral surface of the cylinder 3. When the rotor 4 further rotates, the vanes 17 tend to be pushed back toward the interior of the vane grooves 16 by the inner peripheral surface of the cylinder 3. The refrigerant gas which having flowed into the vane groove bottom portions 16*a* is compressed by the force pushing the vanes 17 back toward the interior of the vane grooves 16. When the rotor 4 further rotates to attain the stage immediately before discharge, communication is established between the vane groove bottom portions 16*a* and the high pressure supplying hole 10, and the compressed high pressure refrigerant gas is discharged into the high pressure supplying hole 10.

The high pressure refrigerant gas discharged into the high pressure supplying hole 10 passes the communication passage 21 formed by the first supplying passage 12 and the second supplying passage 14 before being discharged into the flat groove 11.

The plurality of vane grooves 16 formed in the outer peripheral surface of the rotor 4 and arranged such that one of the vane grooves 16 is always under a suction/compression process. Thus, at the point in time when high pressure refrigerant gas has been discharged into the flat groove 11, one of the vane grooves 16 is in communication with the flat groove 11, and the high pressure refrigerant gas is discharged into the vane groove bottom portion 16*a* in communication with the flat groove 11.

In addition to the centrifugal force due to the rotation of the rotor 4 and the oil pressure of the lubricant supplied to the vane groove bottom portions 16*a* through the flat groove 11, the pressure of this high pressure refrigerant gas is applied to the vanes 17 mounted in the vane grooves 16 into which the high pressure refrigerant gas is discharged, whereby the vanes 17 project to a degree that they are pressed against the inner peripheral surface of the cylinder 3, dividing the cylinder chamber 5 into the compression chambers 5*a*.

That is, during normal operation of the gas compressor, the high pressure supplying hole 10 prevents the vanes 17 from being separated from the inner peripheral surface of the cylinder 3 by the lubricant supplied thereto from the oil sump 7 through the first supplying passage 12. Further, during normal operation of the gas compressor, the first supplying passage 12 supplies lubricant from the oil sump 7 to the high pressure supplying hole 10, and the flat groove 11 supplies lubricant supplied through the clearance of the plain bearing to the vane groove bottom portions 16*a*.

However, in accordance with this embodiment, at the start of the gas compressor, refrigerant gas compressed in the vane groove bottom portions 16*a* is discharged into the high pressure supplying hole 10. Further, the communication passage 21 formed by the first supplying passage 12 and the second supplying passage 14 supplies the high pressure refrigerant gas discharged into the high pressure supplying hole 10 to the flat groove 11. The flat groove 11 supplies the high pressure refrigerant gas supplied from the high pressure supplying hole 10 through the communication passage 21 to the vane groove bottom portions 16*a*.

Thus, in accordance with this first embodiment, the communication passage 21 formed by the first supplying passage 12 and the second supplying passage 14 establishes communication between the high pressure supplying hole 10 and the flat groove 11. Due to the above construction, in addition to the centrifugal force due to the rotation of the rotor 4 and the vane back pressure due to the lubricant supplied to the vane groove bottom portions 16*a* from the flat groove 11, the vane back pressure obtained by supplying high pressure refrigerant gas to the vane groove bottom portions 16*a*, i.e., three forces in total, are applied to the vanes 17. Thus, at the start of the compressor, the projectability of the vanes 17 is dramatically improved, and the vanes 17 divide the cylinders 5 immediately after the start of the compressor to define the compression chambers 5*a*, making it possible to perform suction/compression of refrigerant gas.

Figure 5:
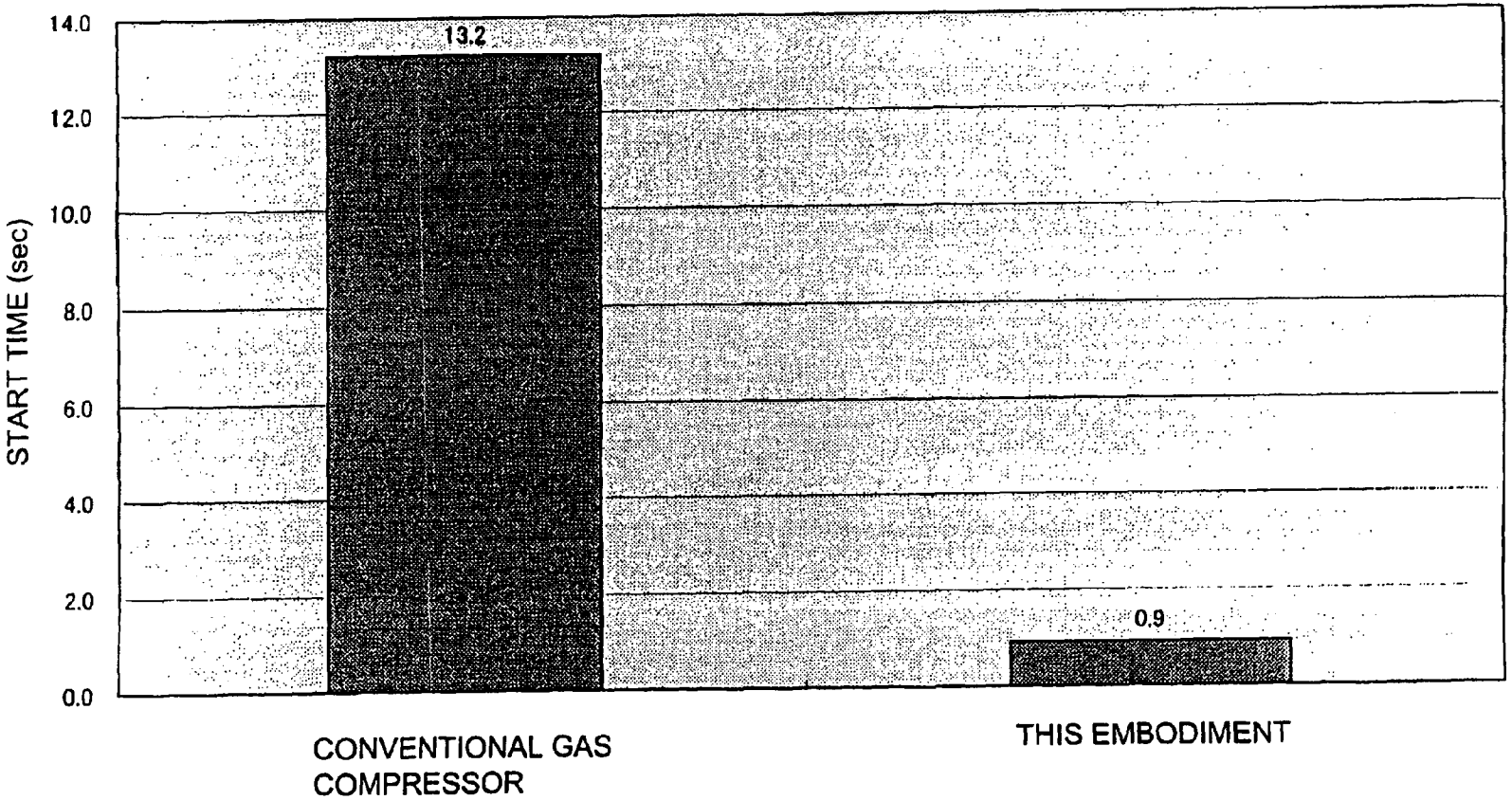
FIG. 5 is a graph comparing the gas compressor of the first embodiment with a conventional gas compressor in terms of starting performance.
Figure 6:
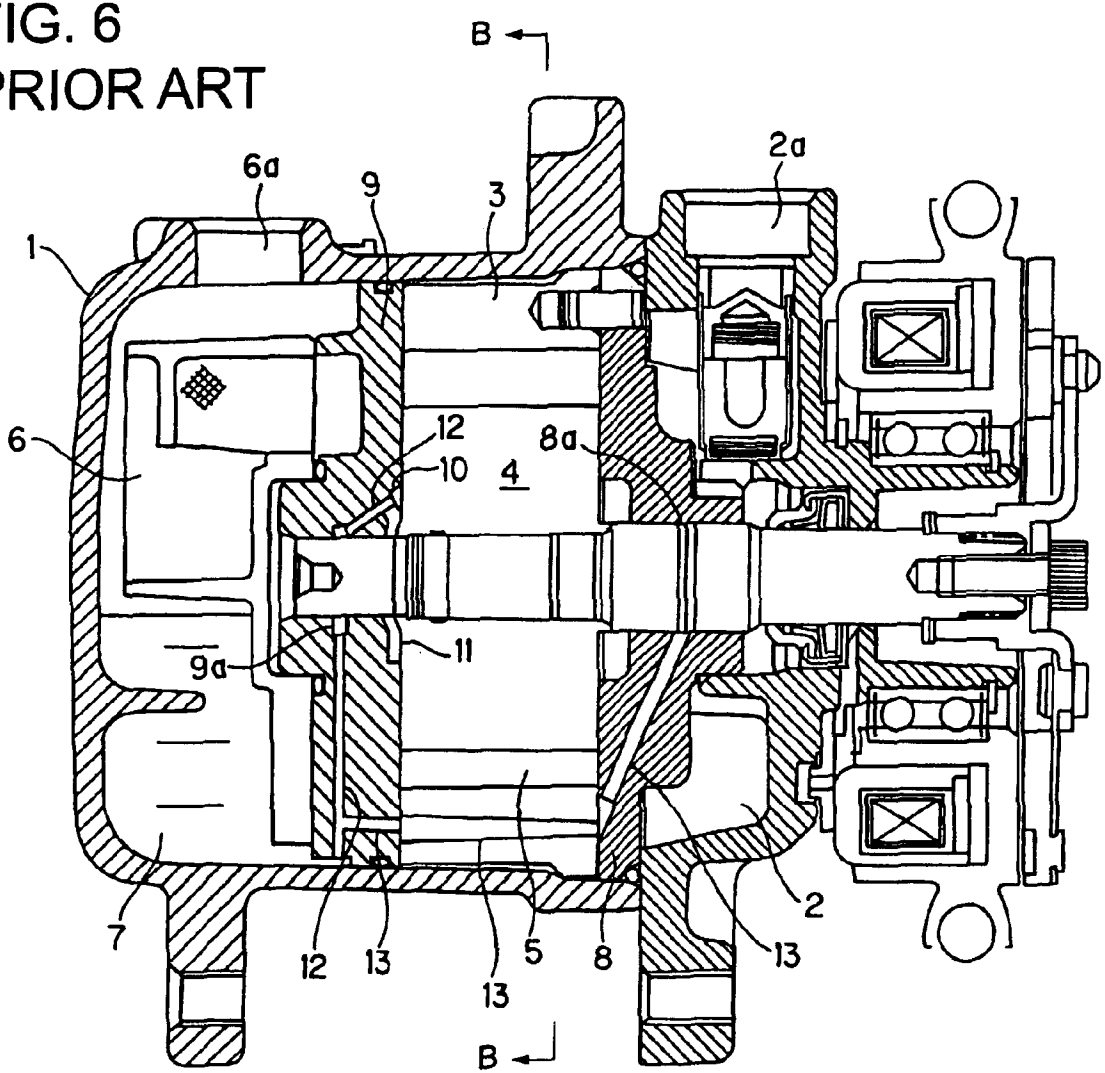
FIG. 6 PRIOR ART
FIG. 6 is a sectional view of the conventional gas compressor.
Figure 7:
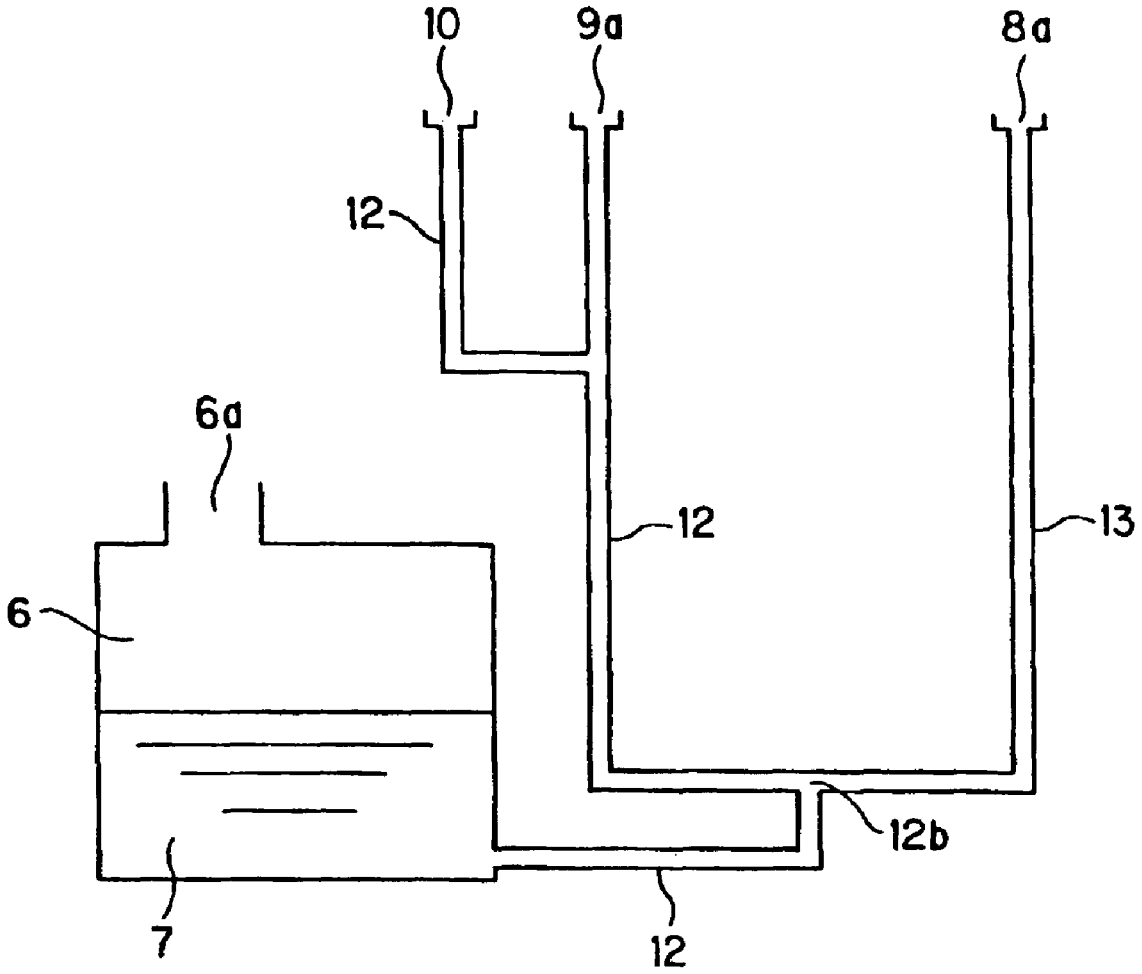
FIG. 7 PRIOR ART
FIG. 7 is a schematic diagram schematically showing a lubricant supplying passage of the conventional gas compressor.

FIG. 5 illustrates the starting performance of the compressor of this first embodiment. The graph of FIG. 5 compares the prior-art technique with this embodiment in terms of starting performance. In an experiment, the rotor 4 was rotated at 800 rpm (Nc=800 rpm) the pressure (Pd) in the exhaust chamber 6 was adjusted to 0.392 MPaG, and the pressure (Ps) in the suction chamber was adjusted to 0.420 MPaG to reproduce the state of the compressor at the start. In this condition, the time it took for the vanes 17 to be pressed against the inner peripheral surface of the cylinder 3 in the suction/compression process was measured. Measurement was performed ten times each for the prior-art technique and this embodiment, obtaining the average values. The experiment results thus obtained are given in the graph.

As shown in FIG. 5, the results of the experiment showed that, in the prior-art technique, it took an average of 13.2 seconds for the vanes 17 to be pressed against the inner peripheral surface of the cylinder 3 in the suction/compression process, whereas, in this embodiment, it took an average of 0.9 seconds. That is, while in the prior-art technique it takes 13.2 seconds for the compressor to start sucking and compressing refrigerant gas after its start, it takes only 0.9 seconds in this embodiment for the suction and compression of refrigerant gas to be started.

As described above, in accordance with this embodiment, communication is established between the high pressure supplying hole 10 and the flat groove 11 by the communication passage 21, whereby the projectability of the vanes 17 at the start of the compressor is dramatically improved, and the vanes 17 divide the cylinder chamber 5 immediately after the start of the compressor to define the compression chambers 5*a*, sucking and compressing refrigerant gas. Thus, no matter how adverse the conditions are, the requisite starting performance is ensured, and chattering, etc., at the time of starting is prevented as well.

Further, the above-mentioned communication passage 21 is formed by the first supplying passage 12 and the second supplying passage 14. As for the first supplying passage 12, through which the lubricant is supplied to the high pressure supplying hole 10, the first supplying passage 12 of the conventional gas compressor is used as it is, and it is only necessary to form the second supplying passage 14, which means modification of a conventional gas compressor can be effected at low cost.

Next, it is also possible for this first embodiment to adopt a construction in which the first pressure control valve 15 is provided in the second supplying passage 14.

In the following, the operation in the case in which the first pressure control valve 15 is provided in the second supplying passage 14 will be described.

In this embodiment, the compressor performs the operation as described above in this embodiment upon starting; the suction/compression of refrigerant gas is immediately started, and high pressure refrigerant gas is discharged into the exhaust chamber 6, resulting in an increase in the pressure in the exhaust chamber 6. As the pressure in the exhaust chamber 6 increases, pressure is applied to the surface of the oil in the oil sump 7, and the lubricant in the oil sump 7 starts to flow through the supplying passages as high pressure lubricant. At the same time, allowed to flow into the second supplying passage is lubricant to be caused to flow to various parts of the gas compressor through the first supplying passage 12 and the third supplying passage 13.

The high pressure lubricant having flowed into the second supplying passage 14 starts to apply pressure to the first pressure control valve 15; when the difference in pressure between the output and input sides of the first pressure control valve 15 becomes equal to or larger than a predetermined value, the first pressure control valve 15 is brought into the closed state, interrupting the second supplying passage 14. Thus, when the compressor starts to suck and compress refrigerant gas, the second supplying passage 14 is interrupted, and the communication passage 21 formed by the first supplying passage 12 and the second supplying passage 14 is brought out of communication, with the result that neither compressed refrigerant gas nor high pressure lubricant is discharged into the flat groove 11 through the second supplying passage 14. That is, when the compressor starts to suck and compress refrigerant gas, the difference in pressure between the exhaust chamber 6 and the flat groove 11 becomes equal to or larger than a predetermined value; and when the pressure of the lubricant flowing into the second supplying passage 14 from the oil sump 7 becomes not less than a predetermined value, the first pressure control valve 15 is brought into the closed state, whereby the supply of lubricant and high pressure refrigerant gas to be discharged into the flat groove 11 through the second supplying passage 14 is interrupted.

Thus, due to the provision of the first pressure control valve 15, no refrigerant gas is discharged from the high pressure supplying hole 10 during normal operation of the compressor, and no high-pressure lubricant is directly discharged into the flat groove 11 through the second supplying passage 14. Thus, the vane back pressure does not exceed the requisite level, and the vanes 17 are not excessively pressed against the inner peripheral surface of the cylinder 3, thereby preventing wear of the forward ends of the vanes 17.

While the pressure of the lubricant for causing the first pressure control valve 15 to interrupt the second supplying passage 14 allows adjustment as appropriate, it is desirable for the pressure to be of a magnitude such that the second supplying passage 14 can be interrupted when the pressure of the discharge gas attains the pressure of the gas compressor during normal operation.

Further, as shown in FIGS. 1 and 2A, the first pressure control valve 15 of this embodiment adopts a spherical valve body and a compression spring, and the pressure of discharge gas, which is the pressure of the gas compressor during normal operation, is applied to the valve body; when the pressure exceeds the urging force of the compression spring, the compression spring is compressed, and the valve body is brought into close contact with the valve seat, thus closing the second supplying passage 14. However, the construction of the first pressure control valve is not restricted to that of this embodiment; for instance, it is also possible for the valve body to be a conical one instead of the spherical one. Any type of valve body is applicable as appropriate in conformity with the specifications as long as it is capable of interrupting the second supplying passage 14 when the pressure of the discharge gas attains the pressure of the gas compressor during normal operation.

(Second Embodiment)

Figure 3B:
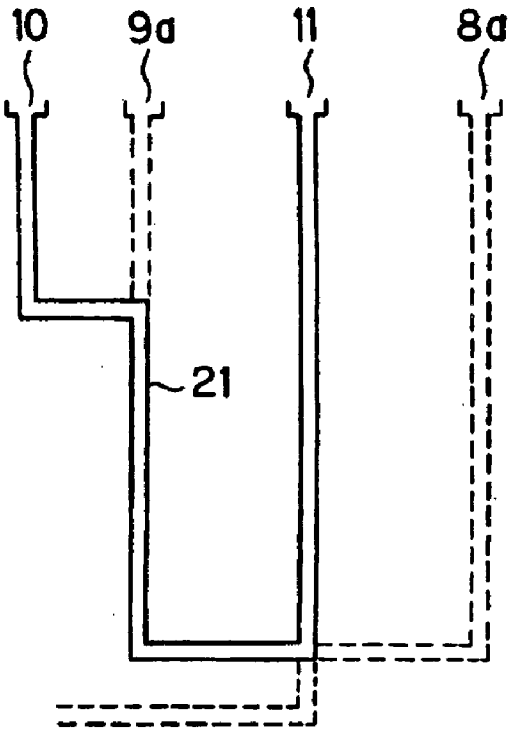
FIGS. 3A and 3B are schematic diagrams schematically showing a main structure portion of a second embodiment.
Figure 3A:
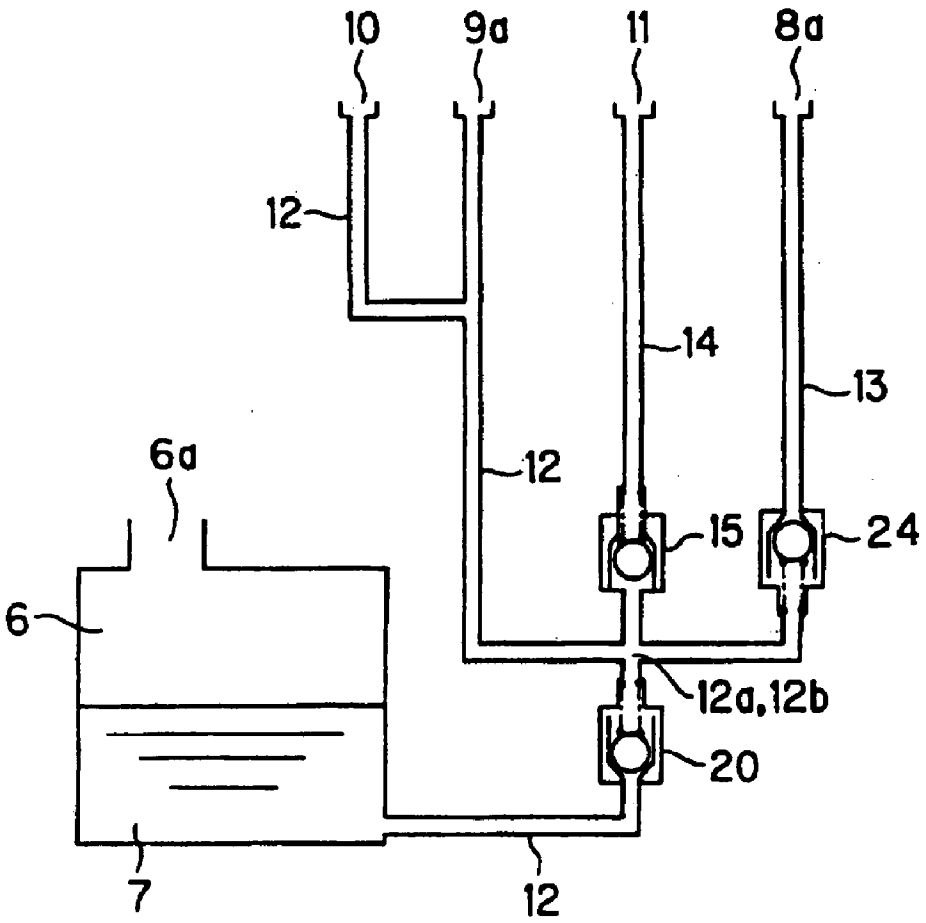

Next, another embodiment of the present invention will be described. FIGS. 3A and 3B are schematic diagrams showing the communication passage 21 and the lubricant supplying passage in the second embodiment of this invention. As in the first embodiment, the communication passage 21 is formed in the rear side block, so that the longitudinal sectional view of the gas compressor will be omitted. In this embodiment, the components which are the same as those of the prior-art technique and the first embodiment are indicated by the same reference numerals, and a detailed description of such components will be omitted.

Like the first embodiment, this second embodiment adopts the construction in which there are provided the communication passage 21 formed by the first supplying passage 12 and the second supplying passage 14, the third supplying passage 13, and the first pressure control valve 15 arranged in the second supplying passage 14.

In addition to the above construction, this second embodiment adopts a construction in which there is provided a second pressure control valve 20 at a position in the first supplying passage 12 on the downstream side of the oil sump 7 and on the upstream side of the branch-off points 12*a* and 12*b* for the second supplying passage 14 and the third supplying passage 13.

In the following, the operation in the case in which, as in this embodiment, the second pressure control valve 20 is provided, will be described. The operation of discharging high pressure refrigerant gas into the high pressure supplying hole 10 in the cylinder 3 is the same as that in the first embodiment, so that a description thereof will be omitted.

When the gas compressor is at rest, there is no high pressure refrigerant gas to be discharged into the exhaust chamber 6, so that the pressure in the exhaust chamber 6 is lower than that during normal operation of the gas compressor. At this time, the difference between the pressure in the exhaust chamber 6 and the pressure at the branch-off point 12*a* for the second supplying passage 14 is not larger than a predetermined value, and the second pressure control valve 20 keeps the first supplying passage 12 in the closed state, interrupting the first supplying passage 12.

As in the first embodiment described above, when the gas compressor starts operation, high pressure refrigerant gas is discharged from the high pressure supplying hole 10 to the flat groove 11 through the communication passage 21 formed by the first supplying passage 12 and the second supplying passage 14. At this time, the first supplying passage 12 is provided so as to communicate also with the oil sump 7; however, since the second pressure control valve 20 is in the closed state, there is no communication between the oil sump 7 and the high pressure supplying hole 10, and no refrigerant gas is discharged into the oil sump 7.

When, further, high pressure refrigerant gas is discharged into the flat groove 11, and high pressure refrigerant gas is discharged into the vane groove bottom portions 16*a*, the refrigerant gas sucking/compressing process is started as described above. At this time, due to the refrigerant gas discharged into the exhaust chamber 6, the exhaust chamber 6 undergoes an increase in pressure, and starts to apply pressure to the surface of the oil sump 7. At the same time, the pressure of the lubricant in the oil sump 7 due to the pressure of the discharged gas starts to be applied to the second pressure control valve 20.

When the pressure in the exhaust chamber 6 has been raised to a level equivalent to that during normal operation of the gas compressor, the first pressure control valve 15 is brought into the closed state and interrupts the second supplying passage 14. At the same time, when the pressure in the exhaust chamber 6 has been raised to a level equivalent to that during normal operation of the gas compressor, the second pressure control valve 20 is brought into the open state, and lubricant starts to flow from the oil sump 7 to the first supplying passage 12 and the third supplying passage 13, effecting lubrication and sealing on various parts of the gas compressor.

Thus, due to the provision of the second pressure control valve 20, the high pressure refrigerant gas discharged from the high pressure supplying hole 10 at the start of the compressor is not discharged into the oil sump 7, and it is possible to supply high pressure refrigerant gas efficiently to the flat groove 11 through the communication passage 21 formed by the first supplying passage 12 and the second supplying passage 14. Further, the vanes 17 project to a degree that they can be pressed against the inner peripheral surface of the cylinder 3, dividing the cylinder chamber 5 to define the compression chambers 5*a*. Then, the pressure in the exhaust chamber 6 is raised to a level equivalent to that during normal operation of the gas compressor, and the second pressure control valve 20 is brought into the open state, whereby lubricant is supplied from the oil sump 7 to various parts of the gas compressor.

Thus, according to this second embodiment, at the start of the compressor, the projectability of the vanes 17 is further improved, and the vanes 17 efficiently divides the cylinder chamber 5 from immediately after the operation start of the compressor, making it possible to suck and compress refrigerant gas. Thus, no matter how adverse the conditions are, the requisite starting performance is ensured, and chattering, etc. at the time of starting is prevented as well.

While the pressure of the lubricant due to the pressure of the discharge gas for attaining the open state of the second pressure control valve 20 allows adjustment as appropriate, it is desirable for the pressure to be of a magnitude which causes the valve to be brought into the open state when the pressure of the discharge gas attains the pressure during normal operation of the gas compressor.

Further, in this embodiment shown in FIG. 3A, a spherical valve body and a compression spring are used in the second pressure control valve 20; when the pressure of the discharge gas becomes that during normal operation of the gas compressor, and the pressure of the lubricant exceeds the urging force of the compression spring, the compression spring is compressed, and the valve body is separated from the valve seat to bring the first supplying passage 12 into the open state. However, the second pressure control valve 20 is not restricted to that of this embodiment; for instance, it may also adopt a conical valve body instead of the spherical one. It is also possible to adopt any type of valve body in conformity with the specifications as long as it is capable of bringing the first supplying passage 12 into the open state when the pressure of the discharge gas attains that during normal operation of the gas compressor.

Next, in this second embodiment, it is possible to further provide in the third supplying passage 13 a third pressure control valve 24 which is of the same construction and operation as the second pressure control valve 20 and which is operative or adapted to be brought into the closed state when the difference between the pressure of the exhaust chamber 6 and the pressure in the third supplying passage 13 is not larger than a predetermined value.

In this construction, at the start of the gas compressor, it is also possible to prevent the high pressure refrigerant gas discharged from the high pressure supplying hole 10 from being discharged into the third supplying passage 13 in addition to the oil sump 7, making it possible to effect supply more efficiently to the flat groove 11 through the communication passage 21 formed by the first supplying passage 12 and the second supplying passage 14.

Therefore, in accordance with this second embodiment, the projectability of the vanes 17 is further enhanced, making it possible to further enhance the above-mentioned effect.

(Third Embodiment)

Figure 4B:
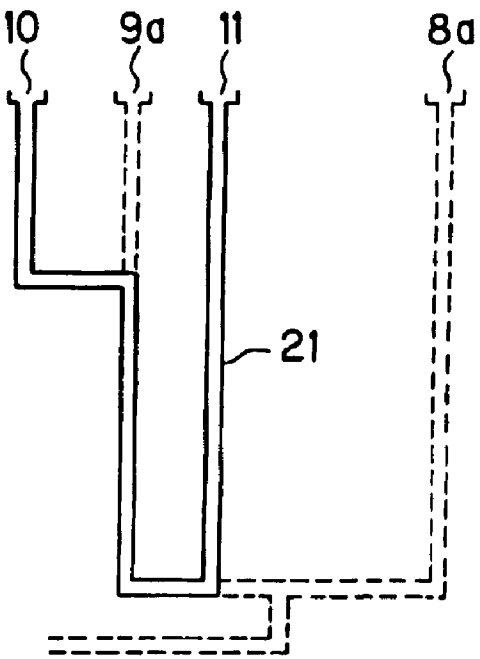
FIGS. 4A and 4B are schematic diagrams schematically showing a main structure portion of a third embodiment.
Figure 4A:
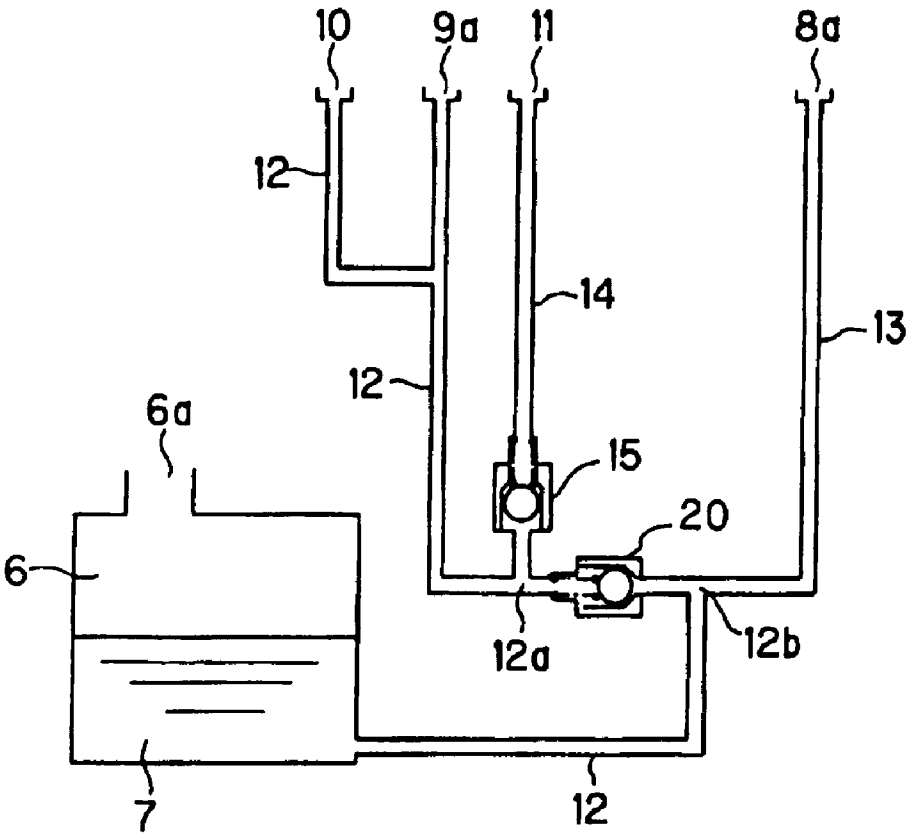

Next, another embodiment of the present invention will be described. FIGS. 4A and 4B are a schematic diagram showing the communication passage 21 and the lubricant supply passage of a third embodiment of this invention. Further, as in the first and second embodiments, the communication passage 21 in this embodiment is formed in the rear side block 9, so that a longitudinal sectional view of the gas compressor will be omitted. Further, the components of this third embodiment which are the same as those of the prior-art technique and the first and second embodiments are indicated by the same reference numerals and a detailed description thereof will be omitted.

Like the first embodiment, this third embodiment adopts the construction in which there are provided the communication passage 21 formed by the first supplying passage 12 and the second supplying passage 14, the third supplying passage 13, and the first pressure control valve 15 arranged in the second supplying passage 14.

In this third embodiment, the second supplying passage 14 branches off from the first supplying passage 12 at a point on the downstream side of the oil sump 7 and on the downstream side of the branch-off point for the first supplying passage 12 and the third supplying passage 13. Further, the second pressure control valve 20 of this embodiment is provided in the first supplying passage 12 at a position between the branch-off point 12*a* for the second supplying passage 14 and the off branch-off point 12*b* for the third supplying passage 13.

The operation of the gas compressor of this third embodiment is the same as that of the first embodiment or the second embodiment, so that a description thereof will be omitted.

In the construction of this third embodiment, the high pressure refrigerant gas discharged from the high pressure supplying hole 10 at the start of the compressor is not discharged into the oil sump 7 and the third supplying passage 13, and the high pressure refrigerant gas is efficiently supplied to the flat groove 11 through the communication passage 21 formed by the first supplying passage 12 and the second supplying passage 14. Further, the vanes 17 project to a degree that they are pressed against the inner peripheral surface of the cylinder 3, and divide the cylinder chamber 5 to define the compression chambers 5*a*. At this time, the pressure of the discharge gas in the exhaust chamber 6 is raised to a level equivalent to that during normal operation of the gas compressor, and the second pressure control valve 20 is brought into the open state, so that lubricant is supplied from the oil sump 7 to various portions of the gas compressor.

Therefore, according to this third embodiment, solely by providing one second pressure control valve 20, it is possible to prevent high pressure refrigerant gas from being discharged into the oil sump 7 and the third supplying passage 13 at the start of the compressor. Thus, high pressure refrigerant gas is efficiently supplied to the flat groove 11, and, at the same time, it is possible to achieve a reduction in cost as compared with the construction in which a pressure control valve having the same function and effect as those of the second pressure control valve is provided in the third supplying passage 13.

Of course, as in the first and second embodiments, regarding the first pressure control valve 15 and the second pressure control valve 20 of this third embodiment also, it is possible to adjust the requisite pressure for opening and closing the valve. Further, regarding the construction of the pressure control valve also, it may be selected as appropriate.

As described above, in the gas compressor of the present invention, there is provided the communication passage 21 for establishing communication between the high pressure supplying hole and the flat groove at the start of the compressor; at the time of starting the compressor, the high pressure refrigerant gas filling the high pressure supplying hole is discharged into the flat groove through the communication passage 21, and the high pressure refrigerant gas is supplied to the vane groove bottom portions communicating with the flat groove in the suction/compression process, so that deficiency in centrifugal force due to low speed rotation of the rotor and deficiency in lubricant supplied to the flat groove are compensated for to enable the vanes to project into the cylinder chamber, making it possible to improve the vane projectability at the start of the compressor, whereby the requisite starting performance is ensured no matter how adverse the conditions are, and it is possible to prevent chattering, etc. at the time of starting.

Further, since the above-mentioned communication passage is formed by the first supplying passage and the second supplying passage, it is possible to use the first supplying passage of the conventional gas compressor as it is as the first supplying passage for supplying lubricant to the high pressure supplying hole, and it is only necessary to form the second supplying passage, which means modification of the conventional gas compressor can be effected at low cost.

Further, due to the provision of the first pressure control valve in the above-mentioned communication passage, no high pressure refrigerant gas or lubricant is directly discharged into the flat groove through the communication passage during normal operation of the gas compressor, so that there is no fear of the vanes being pressed to an excessive degree against the inner peripheral surface of the cylinder, thereby preventing wear of the forward ends of the vanes.

Further, due to the provision of the second pressure control valve and the third pressure control valve described above, the high pressure refrigerant gas discharged from the high pressure supplying hole is not discharged into the oil sump and the third supplying passage at the start of the gas compressor, and is efficiently discharged into the flat groove, so that it is possible to further improve the vane projectability, and, no matter how adverse the conditions are, the requisite starting performance is further ensured, and chattering, etc. at the time of starting can be prevented more reliably.

What is claimed is:

1. A gas compressor for sucking in, compressing, and discharging refrigerant gas, the gas compressor comprising:

an elliptical cylinder;

a rotor rotatably arranged in the cylinder;

vane grooves radially formed in the rotor;

vanes slidably disposed in the vane grooves and capable of projecting and retracting radially with respect to the rotor;

a flat groove configured and arranged to communicate with vane groove bottom portions during a refrigerant gas sucking/compressing process;

a high pressure supplying hole configured and arranged to communicate with the vane groove bottom portions upon interception of the communication between the vane groove bottom portions and the flat groove in the refrigerant gas compressing process; and a communication passage for establishing communication between the flat groove and the high pressure supplying hole at the start of operation of the gas compressor.

2. A gas compressor according to claim 1; further comprising an exhaust chamber for temporarily storing refrigerant gas discharged from the cylinder;

an oil sump formed in a lower portion of the exhaust chamber;

a first supplying passage establishing communication between the oil sump and the high pressure supplying hole; and a second supplying passage branching off from the first supplying passage and communicating with the flat groove;

wherein the communication passage is formed by the first supplying passage and the second supplying passage.

3. A gas compressor according to claim 2; further comprising a first pressure control valve provided in the second supplying passage and operative to be brought into a closed state when the difference between a pressure in the exhaust chamber and a pressure in the flat groove becomes not less than a predetermined value.

4. A gas compressor according to claim 3; further comprising a second pressure control valve provided in the first supplying passage on the downstream side of the oil sump and on the upstream side of a branch-off point for the second supplying passage, and operative to be brought into the closed state when the difference between the pressure in the exhaust chamber and a pressure at the branch-off point for the second supplying passage becomes not more than a predetermined value.

5. A gas compressor according to claim 3; further comprising a third supplying passage situated on the downstream side of the oil sump and branching off from the first supplying passage on the upstream side of the branch-off point for the second supplying passage; and a second pressure control valve situated in the first supplying passage and between the branch-off point for the second supplying passage and the branch-off point for the third supplying passage and operative to be brought into the closed state when the difference between the pressure in the exhaust chamber and the pressure at the branch-off point for the second supplying passage is not more than a predetermined value.

6. A gas compressor according to claim 3; further comprising a third supplying passage further branching off from the branch-off point for the second supplying passage and operative to supply lubricant to a front portion of the interior of a main body of the gas compressor; and a third pressure control valve situated at a position in the third supplying passage behind the branch-off point and operative to be brought into the closed state when the difference between the pressure in the exhaust chamber and the pressure in the third supplying passages is not more than a predetermined value.

7. A gas compressor according to claim 2; further comprising a second pressure control valve provided in the first supplying passage on the downstream side of the oil sump and on the upstream side of a branch-off point for the second supplying passage, and operative to be brought into the closed state when the difference between the pressure in the exhaust chamber and a pressure at the branch-off point for the second supplying passage becomes not more than a predetermined value.

8. A gas compressor according to claim 7; further comprising a third supplying passage further branching off from the branch-off point for the second supplying passage and operative to supply lubricant to a front portion of the interior of a main body of the gas compressor; and a third pressure control valve situated at a position in the gas compressor main body in front of the oil sump and inside the third supplying passage behind the branch-off point and operative to be brought into the closed state when the difference between the pressure in the exhaust chamber and a pressure in the third supplying passages is not more than a predetermined value.

9. A gas compressor according to claim 2; further comprising a third supplying passage situated on the downstream side of the oil sump and branching off from the first supplying passage on the upstream side of the branch-off point for the second supplying passage; and a second pressure control valve situated in the first supplying passage and between the branch-off point for the second supplying passage and the branch-off point for the third supplying passage and operative to be brought into the closed state when the difference between the pressure in the exhaust chamber and the pressure at the branch-off point for the second supplying passage is not more than a predetermined value.

10. A gas compressor according to claim 1; further comprising a first pressure control valve provided in the communication passage and operative to be brought into a closed state when the difference between a pressure in the exhaust chamber and a pressure in the flat groove becomes not less than a predetermined value.

11. A gas compressor comprising:

a compressor case;

a cylinder disposed in the compressor case and having a generally elliptical inner peripheral surface;

a rotationally driven rotor rotatably disposed in the cylinder;

plural vane grooves formed in the rotor and extending inwardly from an outer peripheral surface of the rotor;

plural vanes slidably disposed in respective ones of the vane grooves and cooperating with the inner peripheral surface of the cylinder and the outer peripheral surface of the rotor to define plural compression chambers for intaking a gas, compressing the gas and discharging compressed gas during rotation of the rotor;

means defining an arcuate groove configured and arranged to communicate with bottom portions of the vane grooves during intaking and compression of the gas in the compression chambers;

means defining a high pressure supplying hole configured and arranged to communicate with the bottom portions of the vane grooves during end stage compression of the gas in the compression chambers at times when the bottom portions of the vane grooves are not in communication with the arcuate groove; and a communication passage for establishing communication between the arcuate groove and the high pressure supplying hole at the start of operation of the gas compressor.

12. A gas compressor according to claim 11; further comprising an exhaust chamber for temporarily storing gas discharged from the cylinder;

an oil sump formed in a lower portion of the exhaust chamber;

a first supplying passage establishing communication between the oil sump and the high pressure supplying hole; and a second supplying passage branching off from the first supplying passage and communicating with the arcuate groove;

wherein the communication passage is formed by the first supplying passage and the second supplying passage.

13. A gas compressor according to claim 12; further comprising a first pressure control valve provided in the second supplying passage and operative to be brought into a closed state when the difference between a pressure in the exhaust chamber and a pressure in the arcuate groove becomes not less than a predetermined value.

14. A gas compressor according to claim 13; further comprising a second pressure control valve provided in the first supplying passage on the downstream side of the oil sump and on the upstream side of a branch-off point for the second supplying passage, and operative to be brought into the closed state when the difference between the pressure in the exhaust chamber and a pressure at the branch-off point for the second supplying passage becomes not more than a predetermined value.

15. A gas compressor according to claim 13; further comprising a third supplying passage situated on the downstream side of the oil sump and branching off from the first supplying passage on the upstream side of the branch-off point for the second supplying passage; and a second pressure control valve situated in the first supplying passage between the branch-off point for the second supplying passage and the branch-off point for the third supplying passage and operative to be brought into the closed state when the difference between the pressure in the exhaust chamber and the pressure at the branch-off point for the second supplying passage is not more than a predetermined value.

16. A gas compressor according to claim 13; further comprising a third supplying passage further branching off from the branch-off point for the second supplying passage and operative to supply lubricant to a front portion of the interior of a main body of the gas compressor; and a third pressure control valve situated at a position in the third supplying passage behind the branch-off point and operative to be brought into the closed state when the difference between the pressure in the exhaust chamber and the pressure in the third supplying passages is not more than a predetermined value.

17. A gas compressor according to claim 12; further comprising a second pressure control valve provided in the first supplying passage on the downstream side of the oil sump and on the upstream side of a branch-off point for the second supplying passage, and operative to be brought into the closed state when the difference between the pressure in the exhaust chamber and a pressure at the branch-off point for the second supplying passage becomes not more than a predetermined value.

18. A gas compressor according to claim 17; further comprising a third supplying passage further branching off from the branch-off point for the second supplying passage and operative to supply lubricant to a front portion of the interior of a main body of the gas compressor; and a third pressure control valve situated at a position in the gas compressor main body in front of the oil sump and inside the third supplying passage behind the branch-off point and operative to be brought into the closed state when the difference between the pressure in the exhaust chamber and a pressure in the third supplying passages is not more than a predetermined value.

19. A gas compressor according to claim 12; further comprising a third supplying passage situated on the downstream side of the oil sump and branching off from the first supplying passage on the upstream side of the branch-off point for the second supplying passage; and a second pressure control valve situated in the first supplying passage between the branch-off point for the second supplying passage and the branch-off point for the third supplying passage and operative to be brought into the closed state when the difference between the pressure in the exhaust chamber and the pressure at the branch-off point for the second supplying passage is not more than a predetermined value.

20. A gas compressor according to claim 11; further comprising a first pressure control valve provided in the communication passage and operative to be brought into a closed state when the difference between a pressure in the exhaust chamber and a pressure in the arcuate groove becomes not less than a predetermined value.

* * * * *